US009382738B2

(12) United States Patent
Bonetti

(10) Patent No.: US 9,382,738 B2
(45) Date of Patent: Jul. 5, 2016

(54) SWING CLOSURE FOR DOORS, WINDOWS OR THE LIKE

(71) Applicant: Celegon S.R.L., Mirano (IT)

(72) Inventor: Massimo Bonetti, Padova (IT)

(73) Assignee: CELEGON S.R.L., Mirano (IT)

( * ) Notice: Subject to any disclaimer, the term of this patent is extended or adjusted under 35 U.S.C. 154(b) by 86 days.

(21) Appl. No.: 14/394,749

(22) PCT Filed: Apr. 17, 2013

(86) PCT No.: PCT/IB2013/053035
§ 371 (c)(1),
(2) Date: Oct. 16, 2014

(87) PCT Pub. No.: WO2013/156938
PCT Pub. Date: Oct. 24, 2013

(65) Prior Publication Data

US 2015/0096694 A1 Apr. 9, 2015

(30) Foreign Application Priority Data

Apr. 17, 2012 (IT) ..... PD2012A0117

(51) Int. Cl.
*E05D 15/34* (2006.01)
*E05D 15/26* (2006.01)
*E06B 3/48* (2006.01)

(52) U.S. Cl.
CPC ..... *E05D 15/264* (2013.01); *E05D 15/34* (2013.01); *E06B 3/481* (2013.01); *E06B 3/487* (2013.01); *E05D 15/26* (2013.01); *E05Y 2800/00* (2013.01); *E05Y 2900/132* (2013.01); *E05Y 2900/148* (2013.01)

(58) Field of Classification Search
CPC ..... E05D 15/264; E05D 15/34; E05D 15/14; E05D 15/28; E06B 3/481; E06B 3/487
USPC ..... 160/210, 213
See application file for complete search history.

(56) References Cited

U.S. PATENT DOCUMENTS 2,393,052 A * 1/1946 Mehard ..... E05D 15/262 160/189
2,847,684 A * 8/1958 Pompon ..... A47C 17/1756 5/38

(Continued)

*Primary Examiner* — Blair M Johnson
*Assistant Examiner* — Scott Denion
(74) *Attorney, Agent, or Firm* — Abelman, Frayne & Schwab

(57) ABSTRACT

A swing closure element (1), comprising: —a fixed structure (10) rigidly constrainable to an opening (11) of a door or window or the like, —a first movable wing (20) constrained to said fixed structure (10) by a first hinge constraint (21) so as to be pivotable about a first rotation axis (Z1), according to a predetermined opening rotation direction (W1), —a second movable wing (30) constrained to said first wing by said second hinge constraint (31) so as to be pivotable with respect to the first wing (20) about a second rotation axis (Z2), the first and the second wing (20, 30) being movable between a first closed configuration wherein they are coplanarly arranged to close the opening (11) and a second open configuration, —an articulated, quadrilateral mechanism (50, 50') connected to the fixed structure (10) and to the second wing (30) comprising at least one stiffening member (61, 61', 62, 62') pivotably constrained to said first wing (20) and to a movable member (53, 53') of said mechanism (50, 50') connected to the fixed structure (10) and to said second movable wing (30).

11 Claims, 11 Drawing Sheets

(56) References Cited

U.S. PATENT DOCUMENTS 5,020,580 A * 6/1991 Dalman ..... E05D 15/262 160/188
5,722,101 A * 3/1998 Grigoriev ..... A47C 17/161 297/354.13
5,735,080 A * 4/1998 Pratolongo ..... E05D 15/34 312/325
6,079,762 A * 6/2000 Strasser ..... B60J 5/0498 160/188
6,758,539 B2 * 7/2004 Cianetti ..... A47F 3/007 312/137
7,448,703 B2 * 11/2008 Kung ..... E05D 15/262 162/286
7,946,665 B2 * 5/2011 Backhaus ..... E05D 15/264 312/324
2003/0051609 A1 * 3/2003 Cianetti ..... A47F 3/007 99/485
2005/0056386 A1 * 3/2005 Hicks ..... E05D 15/26 160/199
2010/0117501 A1 * 5/2010 Backhaus ..... E05D 15/264 312/326
2011/0131885 A1 * 6/2011 Ajiki ..... E05C 17/32 49/386
2014/0224435 A1 * 8/2014 Stawski ..... E05D 15/0621 160/188
2015/0096694 A1 * 4/2015 Bonetti ..... E05D 15/34 160/213

* cited by examiner

Z1
Z2
W1
W2
A
B

Z1
Z2
35
50
A
B 11
11a
14a
14b
31
A
B 10
21
15
A
B

1
Z1
Z2
13
12a
12b
20
30
A
B

Z1
Z2'
W1
W2

35
11a
Z1
Z2'
50'

11
14a
14b
31

10
15
21

12b
A
B
Z2'
13
30
1'
Z1
12a
20

SWING CLOSURE FOR DOORS, WINDOWS OR THE LIKE

RELATED APPLICATIONS

National Stage application of International Application PCT/IB2013/053035 filed Apr. 17, 2013 and designating the United States and claiming priority of Italian Application PD2012A000117 filed Apr. 17, 2012, both applications being incorporated herein by reference thereto.

FIELD OF THE INVENTION

The present invention relates to a swing closure element for doors, windows or the like. The present invention also relates to a movement mechanism for this closure element.

BACKGROUND OF THE INVENTION

As is known, swing closure elements are normally used for producing doors, windows, solid shutters, louvred shutters; furniture doors or the like.

In all cases wherein, for reasons of dimensions, a swing solution is not usable or is in any case not optimal, it is also known to use closure elements of the sliding or folding type.

The main drawback of these alternative solutions is represented by the greater complexity thereof both in the fabrication and installation step. For example, in sliding door embodiment it is necessary to provide for one or more guides along or within the support wall. In the folding door embodiment it is instead necessary to provide one or more guides at the threshold or at the door lintel or at both. The presence of sliding guides on the door's fixed structures determines an increase in the operations to be performed during the assembly and installation steps, for both the assembly of the guides and for the correct alignment and registration of the movable elements. The use of sliding guides in general also determined greater noise with respect to the swing solutions.

To overcome the dimensional problems of the swing solution, hybrid sliding and roto-translating swing solutions are also known, wherein the closure element slides and rotates between a closed position and an open position orthogonal to the closed position. In the open position the closure element protrudes from both sides with respect to the passage, for example to the door, on which it is installed. Consequently, with respect to other fully retractable solutions, for some applications this roto-translating closure element is not an optimal solution from the point of view of the dimensions. In all cases it is however desirable to have an alternative solution.

SUMMARY

The aim of the present invention is consequently to provide a new swing closure element for doors, windows or the like, that minimizes the overall dimensions with respect to the known swing solutions, both in the fully open and in the intermediate configurations between this and the closed configuration.

Another aim is to provide a new swing closure element for doors that, with respect to solutions of the sliding or folding type, makes assembly and installation operations particularly quick and simple.

A further aim is to provide an articulated quadrilateral mechanism for the movement of the above-mentioned closure element.

In accordance with a first aspect of the invention, the above-mentioned technical problem is resolved by a swing closure element for doors, windows or the like, comprising:

- a fixed structure, rigidly constrainable to an opening of a door or window or the like, to separate a first space from a second space,
- a first movable wing constrained to said fixed structure by a first hinge constraint so as to be pivotable with respect to said fixed structure about a first rotation axis of said first constraint according to a predetermined opening rotation direction oriented from said first space to said second space and an opposite closure rotation direction oriented from said second space to said first space,
- a second movable wing constrained to said first wing by a second hinge constraint so as to be pivotable with respect to said first wing about a second rotation axis of said second constraint, said first and second wings being movable between a first closed configuration wherein said first and second wings are coplanarly arranged to close said opening and at least a second open configuration wherein the passing between said spaces through said opening is allowed,
- an articulated quadrilateral mechanism connected to said fixed structure and to at least said second wing, said mechanism comprising at least one movable member connected to said fixed structure and to said second movable wing (30) respectively by means of a first pin and a second pin, said closure element being characterized in that said mechanism comprises at least a first stiffening member that is pivotably constrained to said first wing and to said movable member.

According to further advantageous characteristics of possible variant embodiments of the present invention, the articulated mechanism is configured so that in the closed configuration the stiffening member is parallel to and spaced with respect to a plane containing said second axis and the axis of said second pin. This allows optimisation of the movement of the closure element in proximity of the singularity configurations of the articulated quadrilateral consisting of the closed configuration of the closure element.

According to further advantageous characteristics of possible variant embodiments of the present invention, the articulated mechanism is of the parallelogram type comprising a movable member connected to said fixed structure and to said second movable wing respectively by means of a first pin and a second pin, the distance between said first pin and said first axis being equal to the distance between the second pin and said second axis. In these variants, the first hinge constraint allows a 180° rotation of said first movable wing so that in said second open configuration said first wing is rotated by 180° with respect to said first closed configuration and said second wing is superimposed to said first wing.

According to further advantageous characteristics of possible variant embodiments of the present invention, the distance between said first pin and said first axis is greater than the distance between said second pin and said second axis, so as to move the second wing up to a second open configuration wherein said first wing is rotated by 90° with respect to said first closed configuration and said second wing is superimposed to said first wing.

With respect to the normal swing closure solutions, the closure element of the present invention allows the dimensions to be reduced in the fully open configuration and in all the intermediate configurations.

With respect to the known folding solutions, the closure element of the present invention guarantees a more ergonomic opening and closing movement. In addition, the assembly results quicker and simpler, sliding guides not being provided on the fixed structure of the closure element.

With respect to the sliding closure element solutions, in the fully open configuration the same dimensions are substantially obtained, but with a movement system without sliding guides, assemblable in a quicker and simpler manner. In addition, the absence of sliding guides makes the solution of the present invention quieter with respect to the other known solutions.

According to further advantageous characteristics of possible variant embodiments of the present invention, the mechanism of the present invention comprises a pair of stiffening members respectively arranged in proximity of said second wing and to said fixed structure and pivotably constrained to said first wing and to said movable member in such a way that in said closed configuration said first stiffening member is parallel and spaced with respect to a plane containing said second axis and the axis of said second pin. The second hinge constraint, the second pin and the first stiffening member are mutually arranged in such a way that in said closed configuration said first stiffening member faces the second space with respect to the plane containing said second axis and the axis of said second pin. The second stiffening member, the first hinge constraint, the first pin and said second stiffening member are mutually arranged in such a way that in said closed configuration said second stiffening member faces said first space with respect to a plane containing the first axis and the axis of said first pin.

In the above-described arrangement, the stiffening members allow the movement mechanism to be suitably stiffened thereby guaranteeing the constant regularity of motion.

In accordance with a second aspect of the invention, the above-mentioned technical problem is resolved by means of an articulated quadrilateral movement mechanism having the above-described characteristics.

BRIEF DESCRIPTION OF THE DRAWINGS

Further characteristics and advantages of the present invention will become clearer from the following detailed description of preferred, but non-exclusive embodiments, illustrated by way of a non-limiting example, with reference to the accompanying drawings, in which.

DETAILED DESCRIPTION OF THE INVENTION

Figures 1A, 1B, 1C, 1D, 1E:
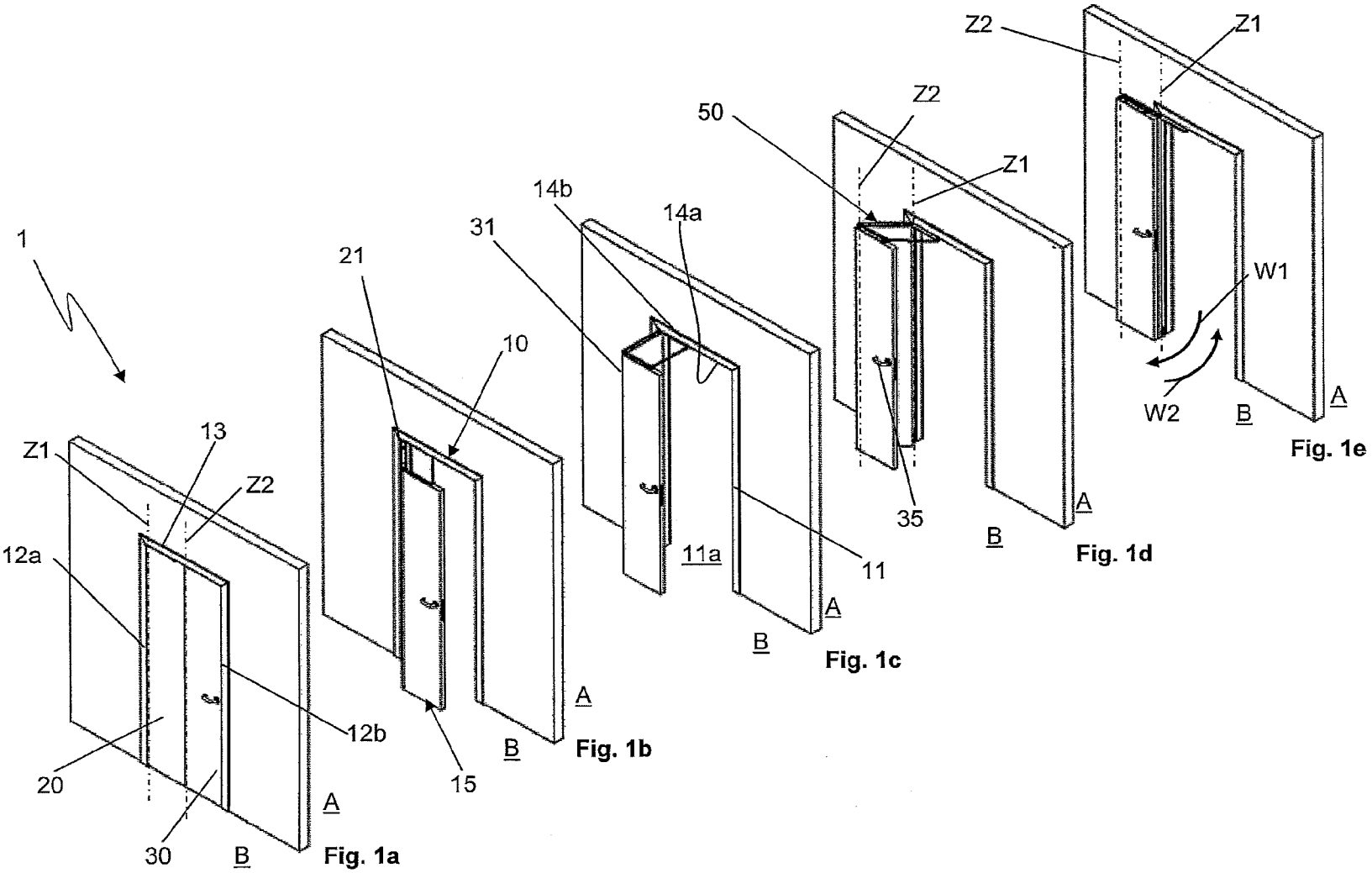
FIGS. 1*a-e* are five axonometric views of a first variant embodiment of a swing closure element according to the present invention, respectively in a first closed configuration, in three distinct intermediate configurations and in a fully open configuration.
Figures 2A, 2B, 2C, 2D, 2E:
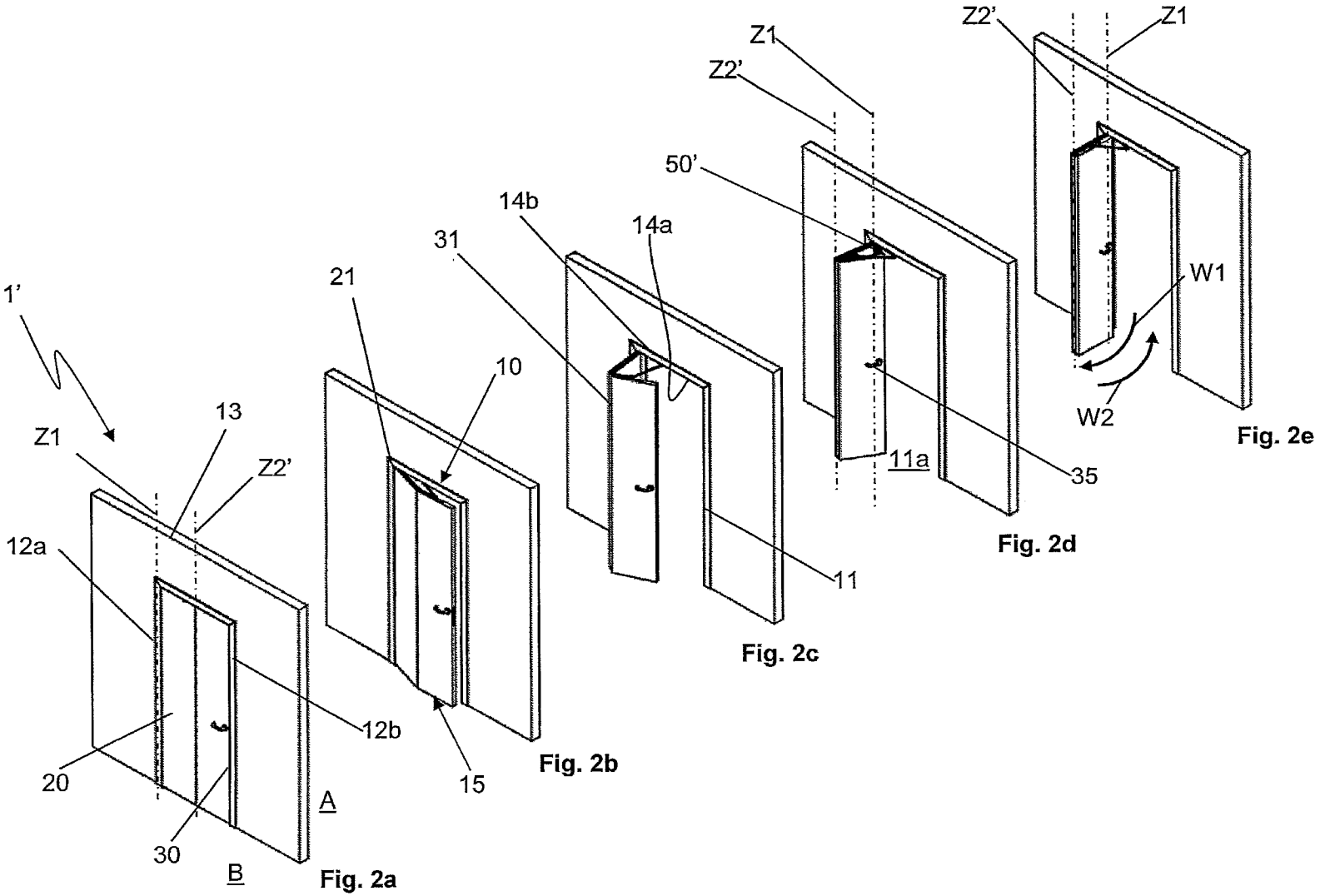
FIGS. 2*a-e* are five axonometric views of a second variant embodiment of a swing closure element according to the present invention, respectively in a first closed configuration, in three distinct intermediate configurations and in a fully open configuration.

With initial reference to the accompanying FIGS. 1*a-e*, a swing closure element is globally indicated by 1.

In the examples of the accompanying figures, the closure element 1 is a door.

According to other embodiments (not shown) the closure element of the present invention is a window, or a louvred shutter, or a solid shutter, or a swing closure for furniture or another type of swing closure element comprising a fixed structure 10, a first movable wing 20 and a second movable wing 30, constrained to each other and movable movable as described in detail below.

The fixed structure 10 is rigidly constrainable to an opening 11 of a door or window or the like, which separates a first space A from a second space B. A passage threshold 11*a* is defined between the first and the second space A, B, at the base of the opening 11. The fixed structure comprises a pair of vertically extending jambs 12*a,b* and a lintel 13, horizontally extending between the jambs 12*a,b*, at the top of the opening 11. The structure 10 comprises a first front surface 14*a* facing the first space A and a second front surface 14*b* facing the second space B. The first and the second front surfaces 14*a,b* are both extended at both the jambs 12*a,b* and the lintel 13.

The closure element 1 also comprises a movable two-door structure 15 including a first movable wing 20 and a second movable wing 30. The first wing 20 is constrained to the fixed structure 10, at one of the jambs 12*a*, by means of a first hinge constraint 21 so as to be pivotable with respect to the fixed structure 10 about a first rotation axis Z1 of the first hinge constraint 21. The rotation axis Z1 is oriented in a vertical direction parallel to the jambs 12*a,b*. The first wing 20 is pivotable about the rotation axis Z1, according to a predetermined opening rotation direction W1 oriented from the first space A to the second space B and an opposite closing rotation direction W2 oriented from the second space B to the first space A. The first hinge constraint 21 consists of a first pair of pivot joints 21*a,b* aligned to each other and respectively arranged in proximity of the lintel 13 and the threshold 11*a*.

The second movable wing 30 is fixed to the first wing 20 by a second hinge constraint 31 so as to be pivotable with respect to the first wing 20 about a second rotation axis Z2 of the second constraint 31. The first and the second constraint 21,31 allow the first and the second wing 20, 30 to be movable between a first closed configuration wherein the first and the second wing 20, 30 are coplanarly arranged to close the opening 11 (FIG. 1*a*) and a second fully closed open configuration wherein the passage between the first and the second space A, B through the opening 11 (FIG. 1*e*) is permitted and wherein the second wing 30 is superimposed to the first wing 20. The second hinge constraint 31 consists of a second pair of pivot joints 31*a,b* aligned to each other and respectively arranged in proximity of the lintel 13 and the threshold 11*a*.

With respect to the first wing 20, the first hinge constraint 21 is arranged at one edge 20*a*, which in the first closed configuration faces the second space B. With respect to the fixed structure 10, the first hinge constraint 21 is arranged so that the first rotation axis is aligned with the second front surface 14*b* or spaced therefrom by the part of the second space B.

The second hinge constraint 31 is arranged at two respective edges 20*b*, 30*b* of the first and the second wing 20, 30, adjacent to each other and facing the first space A in the first closed configuration.

By virtue of this arrangement of the first and of the second hinge constraint 21, 31, respective 180° rotations of the first wing 20 and of the second wing 30 are respectively permitted about the first and the second rotation axis Z1, Z2, even when the respective pairs of pivot joints 21*a,b* and 31*a,b* consist of simple pins, as in the example embodiments of the accompanying figures.

According to other variant embodiments of the invention (not shown), the first and the second hinge constraint 31 consist of special joints, constrained to the wings 20, 30, almost at an intermediate centre plane between the spaces A, B.

A handle closure 35 with a possible cylinder lock, both of known and conventional type normally used in normal wing doors, is provided between the second movable wing 30 and the door jamb 12*b*.

Figure 3:
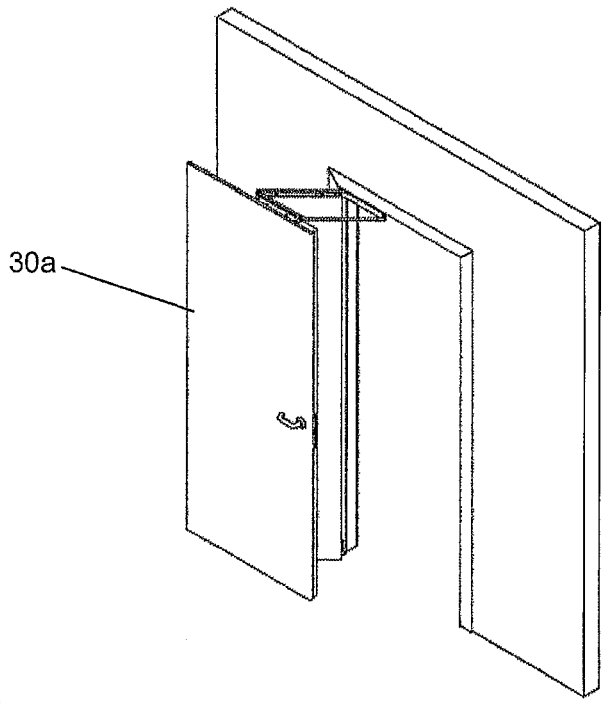
FIG. 3 is an axonometric view, corresponding to that of FIG. 1*d*, of a third variant embodiment of the closure element of FIG. 1*a-e;*

With reference to the variant embodiment of FIG. 3, a panel 30*a* having height and width equal to the corresponding dimensions of the opening 11, is superimposable to the second wing 30. The panel 30*a*, in all the configurations of the closure element 1 conceals from view, from the side of the second space B, the wings 20, 30, and in particular the joint between them at the second constraint 31. In particular, in the closed configuration and in the fully open configuration the panel 30*a* gives the closure element 1 appearance and dimensions almost equal to the appearance and dimensions of a traditional swing door solution.

Figure 11:
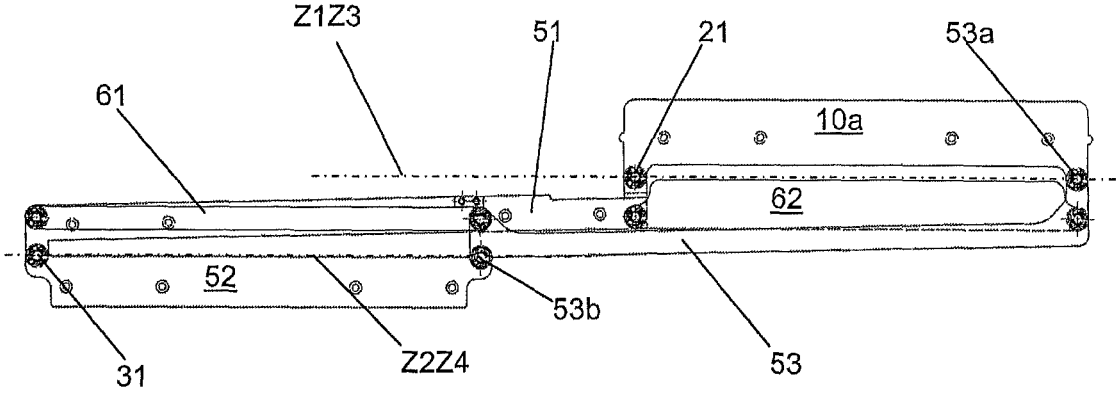
Figure 12:
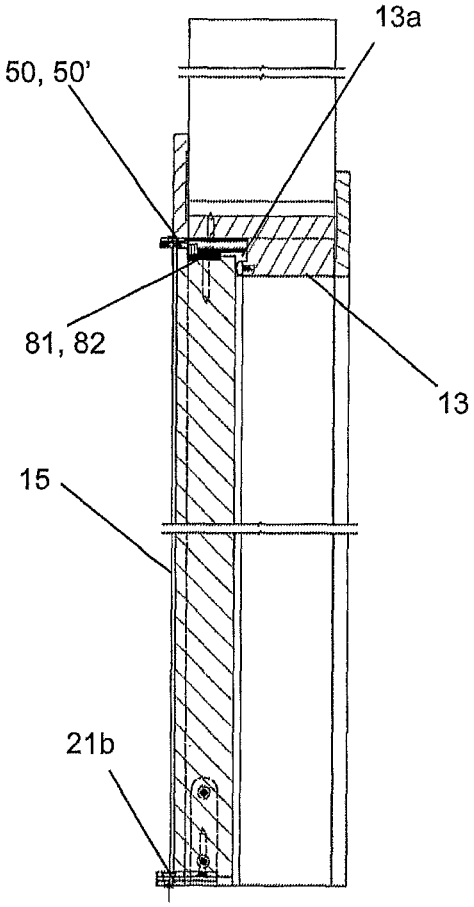
FIG. 12 is a vertical sectional view of the closure elements of FIGS. 1*a-e* and 2*a-e;*
Figure 14:
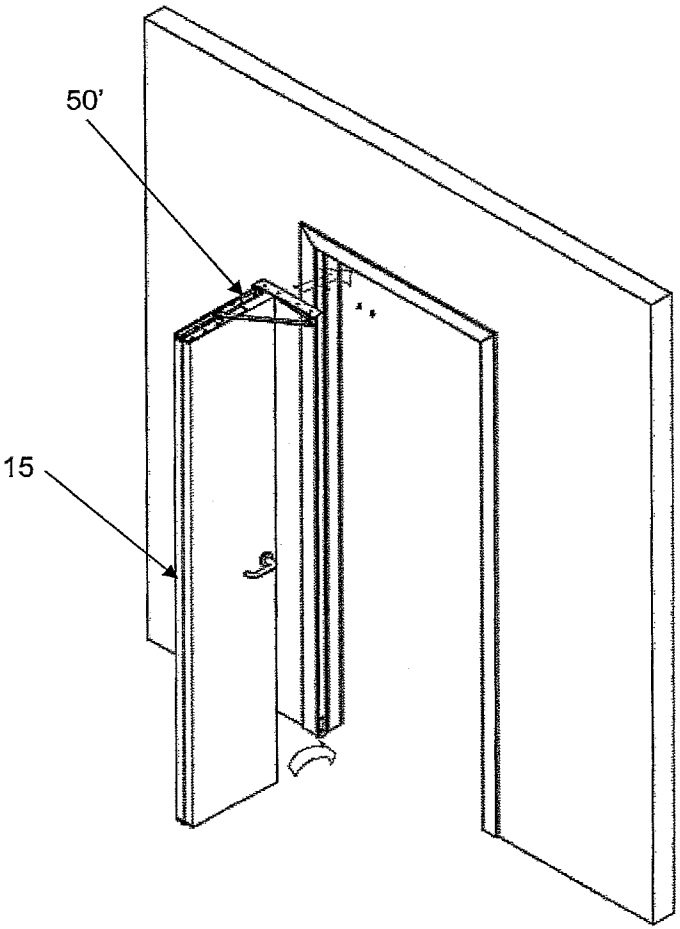
FIGS. 13 and 14 are two respective exploded axonometric views of the closure element of FIGS. 2*a-e* in the two respective assembly configurations.
Figure 13:
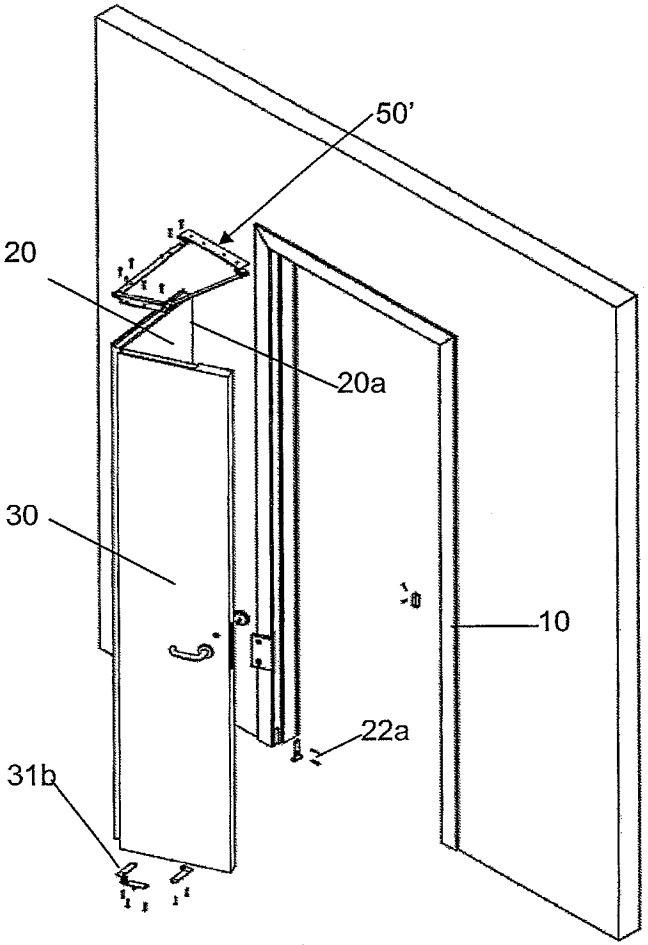
Figure 15:
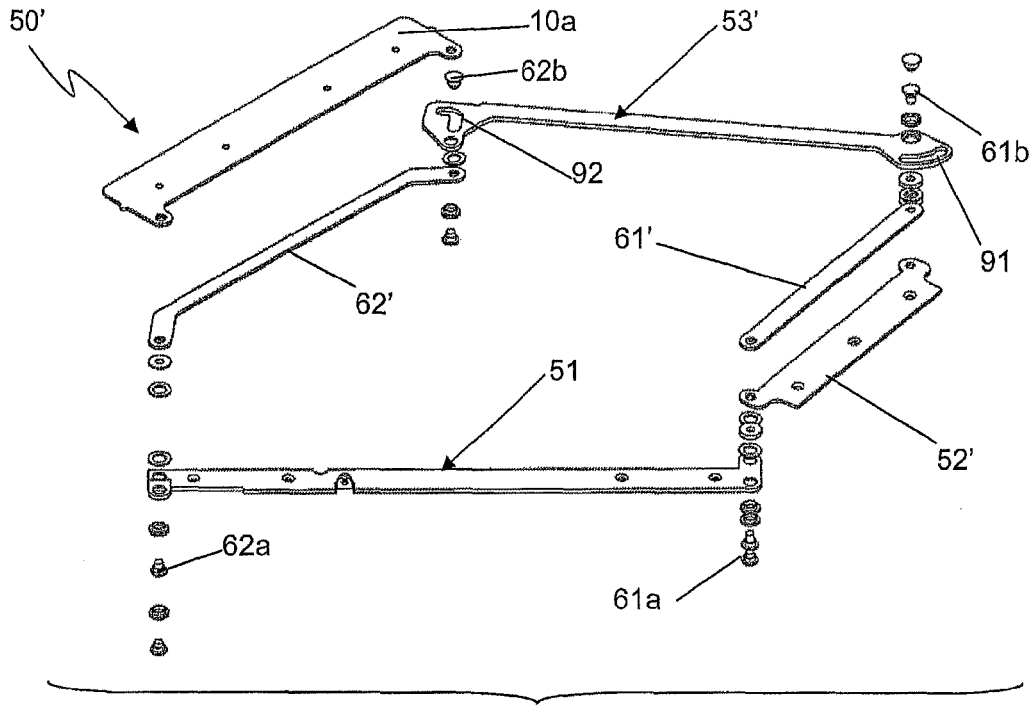
FIG. 15 is an exploded axonometric view of an articulated quadrilateral mechanism according to the present invention, usable for the articulated movement of the closure element of FIGS. 2*a-e;*
Figure 16:
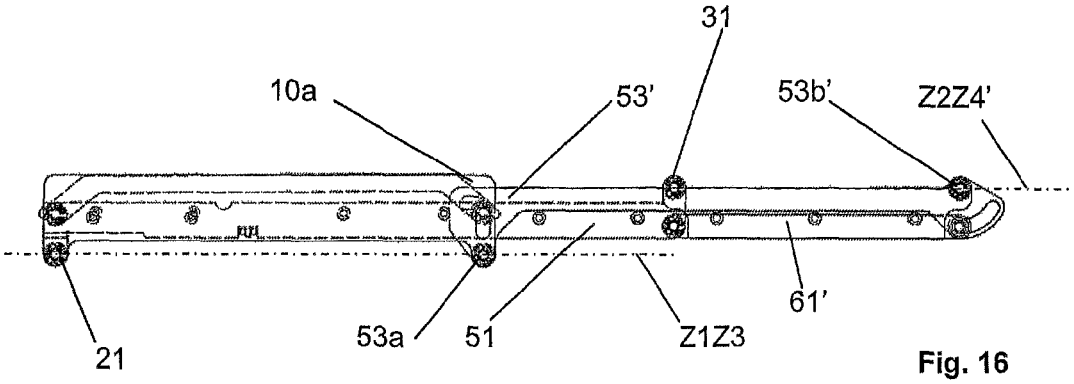
FIG. 16 is a top plan view of the mechanism of FIG. 15.
Figure 17:
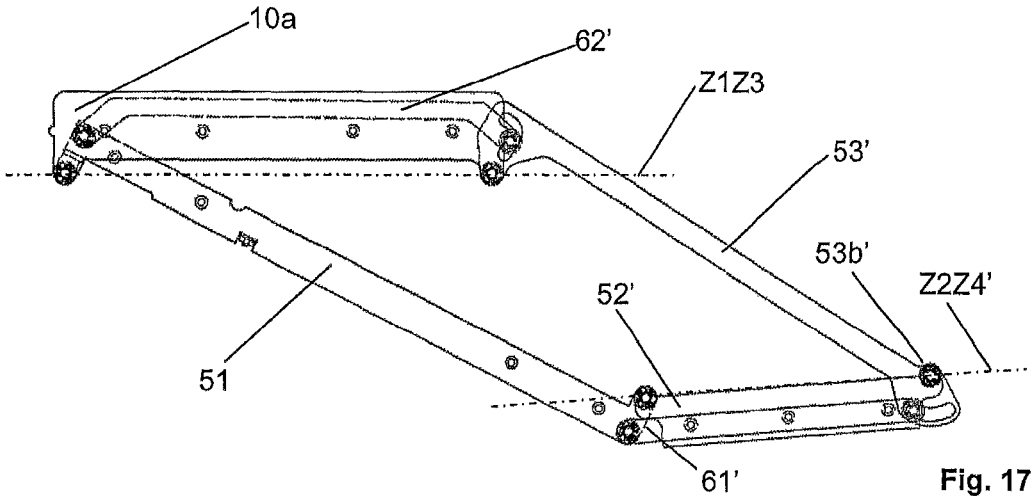
FIGS. 17-19 are three top plan views of the mechanism of FIG. 15 respectively corresponding to the configurations of FIGS. 2*b*, 2*c* and 2*e;*

The closure member 1 comprises an articulated parallelogram mechanism 50 connected to the fixed structure 10 and to the movable wings 20, 30 in such a way that the second wing 30 is movable with respect to the fixed structure 10, between the closed (FIGS. 1*a* and 7*a-c*) and fully open configurations (FIGS. 1*e* and 11), remaining parallel with respect to the opening 11.

With reference to the accompanying FIGS. 6-11, the mechanism 50 comprises a first plate-shaped fixed member 10*a* rigidly constrained by means of a removable threaded coupling to a lower edge of the lintel 13 facing the opening 11. The mechanism 50 also comprises a first and a second movable member 51, 52 that are rigidly constrained by respective removable threaded couplings, respectively to the first movable wing 20 and to the second movable wing 30. The mechanism 50 further comprises a fourth member 53 that is movable, plate-shaped and pivotably connected to the first fixed member 10*a* and to the second movable member 52 respectively by means of a first pin 53*a* and a second pin 53*b*, having respective rotation axes Z3, Z4 that are parallel to the first and to the second rotation axes Z1, Z2. The pins 53*a,b* are of a known and conventional type. The distance between the rotation axis Z3 of the first pin 53*a* is the first rotation axis Z1 is equal to the distance between the rotation axis Z4 of the second pin 53*b* and the second axis Z2. The four members 10*a*, 51, 52, 53 of the mechanism 50 are predominantly developed according to respective longitudinal directions. In the first closed configuration the members 10*a*, 51, 52, 53 are parallel and aligned to each other in the direction defined by the lintel 13 of the opening 11. During the movement of the mechanism 50 (FIGS. 8-10 respectively corresponding to FIGS. 1*b-d*), the first fixed member 10*a* and the second movable member 52 remain parallel to the closed configuration while the first and the third movable members 51, 53 respectively rotate about the first and second rotation axis Z1, Z2, while remaining parallel to each other.

Figure 7A:
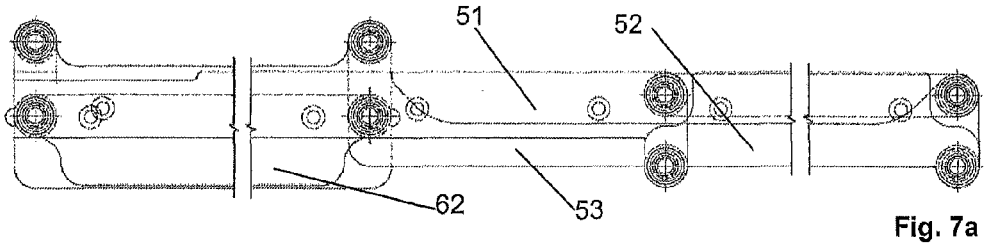
FIGS. 7*a-c* are three orthogonal views of the mechanism of FIG. 6, respectively in bottom plan, side elevation and top plan view.
Figure 7B:
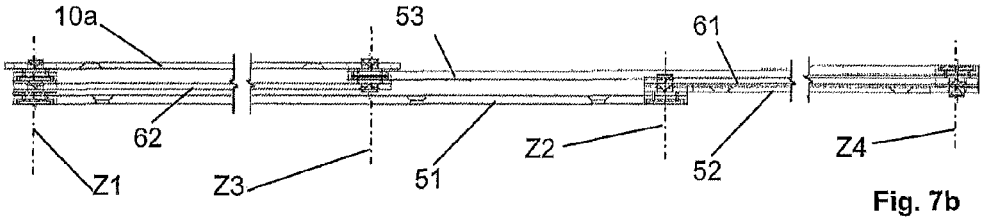
Figure 7C:
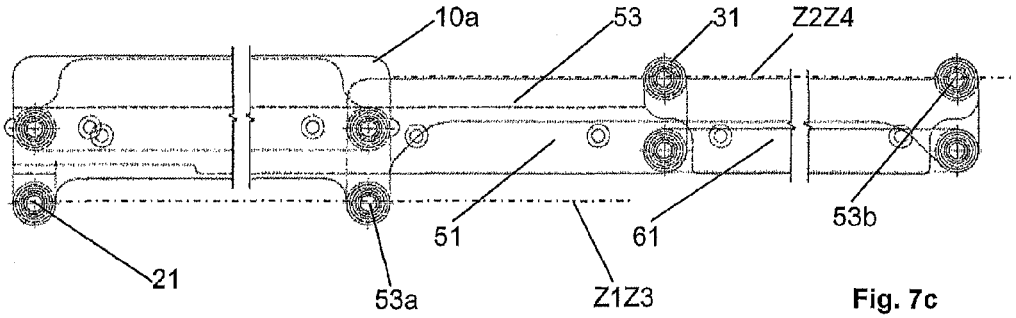
Figure 8:
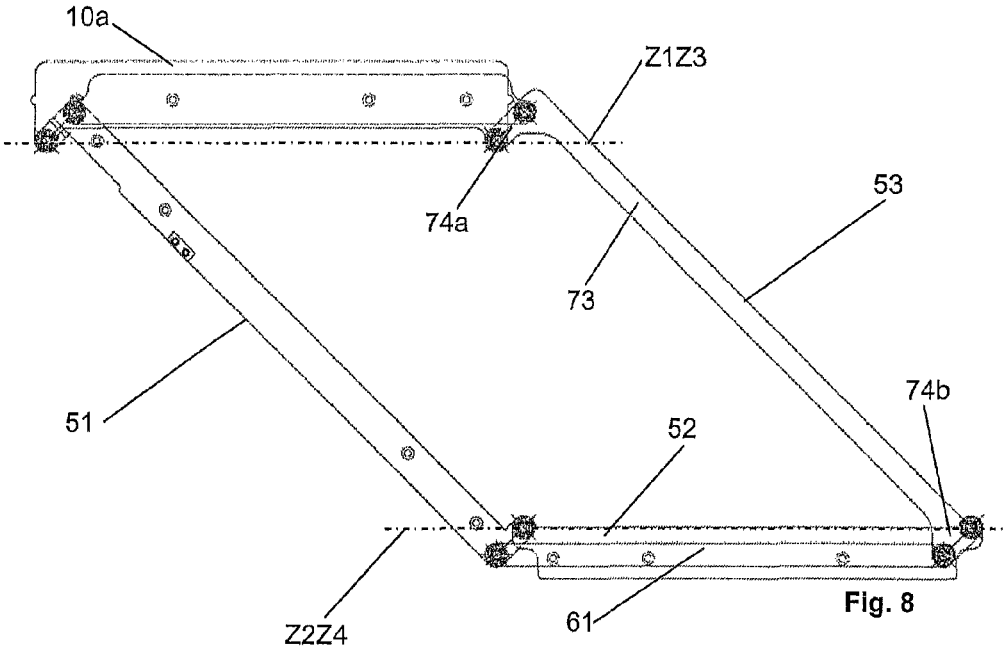
FIGS. 8-11 are four top plan views of the mechanism of FIG. 6 respectively corresponding to the configurations of FIGS. 1*b-e;*
Figure 9:
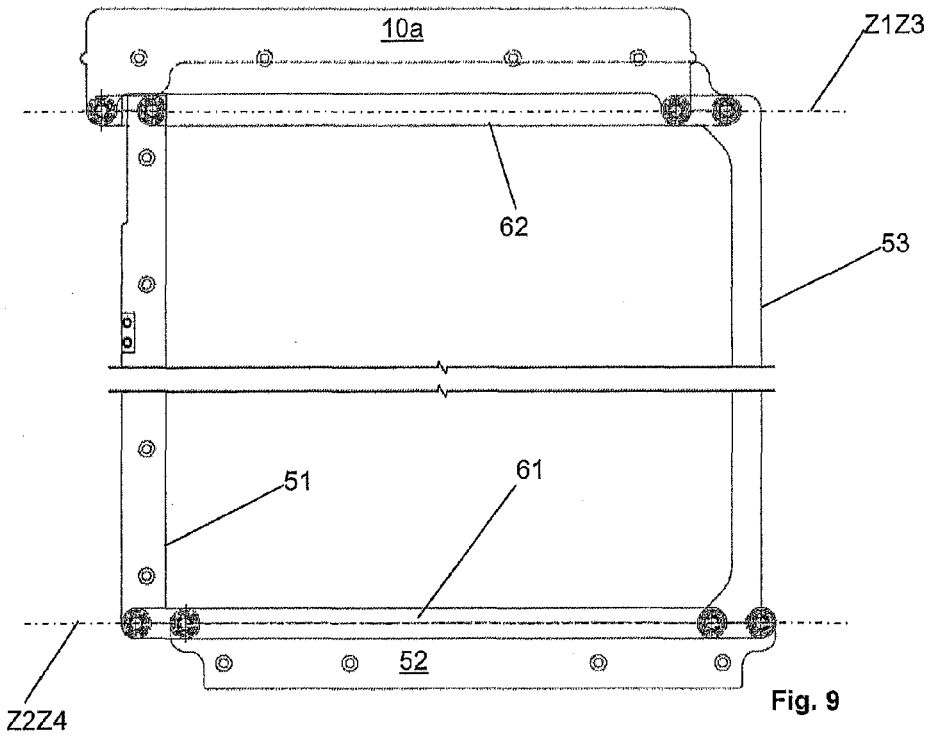
Figure 10:
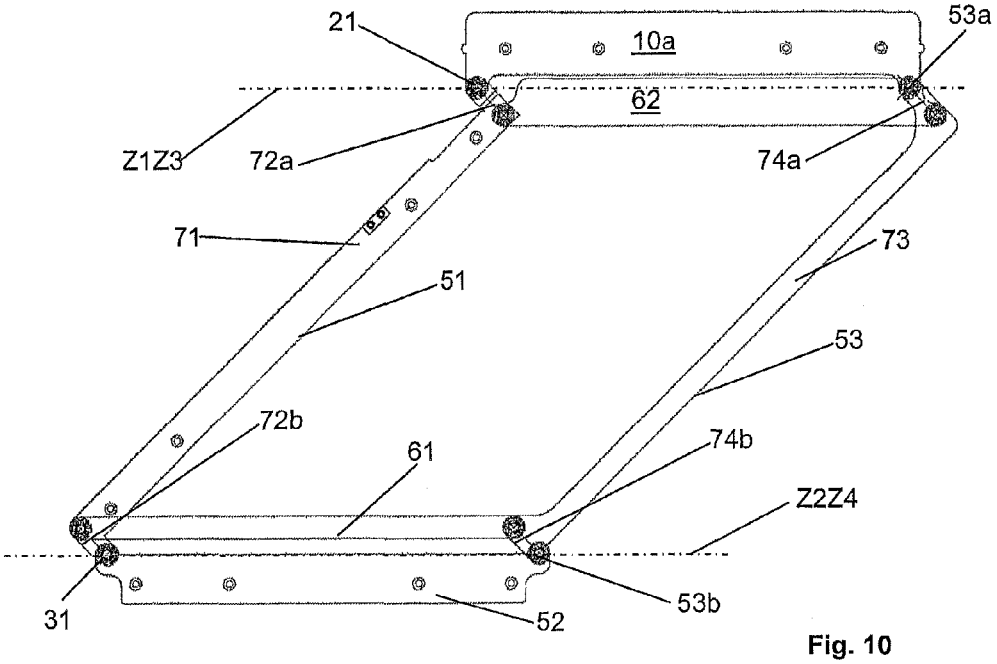

The first movable member 51 comprises a central, plate-shaped portion 71 longitudinally extending and susceptible to being arranged parallel to the lintel 13 in the first closed configuration. The first movable member 51 also comprises, at the opposite ends of the central portion 71, two respective end portions 72*a,b* orthogonal to the central portion 71 in a plan view (FIGS. 7*a*, 7*c*). In a side elevation view, the end portion 72*a* protrudes with respect to the central portion 71, in a direction orthogonal thereto. At the free ends of each of the terminal portions 72*a,b* are respectively provided the pivot joints 21*a* and 31*a* of the first and second hinge constraint 21, 31. The two end portions 72*a,b* are arranged so as to be respectively face the second space B and the first space when the closure element 1 is in the first closed configuration. In this configuration, in a plan view (FIGS. 7*a* and 7*c*) a straight line passing through the centres of the pivot joints 21*a* and 31*a* is misaligned with respect to the wings 20, 30 and the lintel 13, so that for this extreme configuration the mechanism 50 is not in the theoretical stuck configuration.

The third movable member 53 is plate-shaped and comprises a central portion 73 extending longitudinally and susceptible to being arranged parallel to the lintel 13 in the first closed configuration. The third movable member 53 further comprises, at opposite longitudinal ends of the central portion 73, two respective end portions 74*a,b* orthogonal to the central portion 73, both facing the second space B when the closure element 1 is in the first closed configuration. The first pin 53*a* and the second pin 53*b* are respectively positioned at the free end of the end portion 74*a* and of the elbow between the central portion 73 and the other end portion 74*b*. This positioning of the first pin 53*a* and of the second pin 53*b* determines that in a plan view (FIGS. 7*a* and 7*c*) a straight line passing through the centres of the pins 53*a, b* can be misaligned with respect to the wings 20, 30, and the lintel 13, so that for this extreme configuration the mechanism 50 is not in the theoretical stuck configuration.

The conformations of the first and third movable member 51, 53 determine the fact that the first and second hinge constraint 21, 31 are arranged in the closed configuration in such a way that a first plane Z1Z3 containing the first axis Z1 and the axis Z3 of the first pin 53*a* is parallel to and spaced from a second plane Z2Z4 containing the second axis Z2 and the axis Z4 of the second pin 53*b*. The planes Z1Z3 and Z2Z4 are both parallel to the opening 11 and respectively face the second space B is the first space A, respectively, so that the opening rotation direction W1 is oriented from the second plane Z2Z4 to the first plane Z1Z3.

In the first closed configuration (FIGS. 1*a* and 7*a-c*) and in the fully open configuration (FIGS. 1*e* and 11) the mechanism 50, while not being in the theoretical stuck condition, is very close to the latter. To ensure the regularity of movement, even in this extreme configuration, the mechanism 50 comprises a first stiffening member 61 and a second stiffening member 62.

The first stiffening member 61 is plate-shaped and extended in a prevalent longitudinal direction and is pivotably constrained, at the opposite longitudinal ends, by means of respective pins 61*a,b* coupled to respective holes located on the elbow between the central portion 71 and the end portion 72*b* of the first movable member 51 and on the free end of the end portion 74*b* of the third movable member 53, respectively. Thus, in the closed configuration, the first stiffening member 61 is parallel to and spaced with respect to the second plane Z2Z4 and faces, with respect thereto, the second space B. In the fully open configuration, by effect of the 180° rotation, the first stiffening member 61 on the other hand faces, with respect to the second plane Z2Z4, the first space A.

Also the second stiffening member 62 is plate-shaped and extended according to a prevalent longitudinal direction. At the opposite longitudinal ends, the second stiffening member 62 is pivotably constrained by means of respective pins 62*a,b* coupled to respective holes provided on the elbow between the central portion 71 and the end portion 72*a* of the first movable member 51 and on the elbow between the central portion 73 and the end portion 74*a* of the third movable member 53. Thus, in the closed configuration, the second stiffening member 62 is parallel to and spaced from the first plane Z1Z3 and faces, with respect thereto, the first space A. In the fully open, by effect of 180° rotation, the second stiffening member 62 instead faces, with respect to the first plane Z1Z3, the second space B.

The pins at the ends of the first and second stiffening member 61, 62 are per se known and conventional, of the type substantially identical to the pins by means of which the pivot joints 21*a* and 31*a* and the first and the second pin 53*a,b* of the third movable member 53 of the mechanism 50 are obtained. In order to guarantee that the coupling between the pins and members of the mechanism 50, each of the members 10*a*, 51, 52, 53, 61, 62 of the mechanism 50 comprises respective holes in the respective positions provided for the pivot joints 21*a* and 31*a*, for the first and the second pin 53*a,b* and for the pins at the longitudinal ends of the stiffening members 61, 62.

The length of the first stiffening member 61 and of the second stiffening member 62 is equal to the distance between the first rotation axis Z1 and the rotation axis of the first pin 53*a* and to the distance between the second rotation axis Z2 and Z4 of the second pin 53*b*. In the closed configuration and in the fully open configuration, the first stiffening member 61 and the second stiffening member 62 are orthogonal, in the plan views (FIGS. 7*a*, 7*c*) to the end portions 72*a,b* and 74*a,b* of the first and of the third movable member 51, 53. Thus, the presence of the stiffening members 61, 62 offsets the lack of stall torque in the mechanism 50 in the two closed and fully open configurations, i.e. in the configurations close to the theoretical stuck configurations. In these configurations the stiffening members 61, 62 act as tie rods guaranteeing the correct operation of the mechanism 50 and of the closure element 1. In particular, starting from the fully closed configuration, the presence of the first stiffening member 61 prevents the second wing 30 from tending to move rotating about an axis close to the closing 35, as in the traditional folding elements, while the presence of the second stiffening member 62 prevents the first and the second wing 20, 30 from tending to move remaining coplanar, as if the closure element 1 consisted of a traditional swing closure.

With reference to a front elevation view (FIG. 7*b*), parallel to the rotation axes Z1, Z2, the fixed member 10*a* and the first movable member 51 are axially opposing, so that between them there is defined a manoeuvre volume for the second and the third movable member 52, 53 and for the stiffening members 61, 62. The dimension of this manoeuvre volume in the axial direction is defined by the height of the end portion 72*a* of the first movable member 51 connected to the fixed member 10*a* by the pivot joint 21*a*.

The mechanism 50, consisting of the members 10*a*, 51, 52, 53, 61, 62 connected to each other as described above constitutes an assembly that is individually manipulable and easily connectible to the fixed structure 10 and to the movable wings 20, 30 to form the closure element 1, as described in detail below.

The connection of the members 10*a*, 51, 52, 53, 61, 62 obtained as described above also makes it possible to obtain a reduced dimension of the mechanism 50 in a direction parallel to the rotation axes Z1, Z2.

Figure 4:
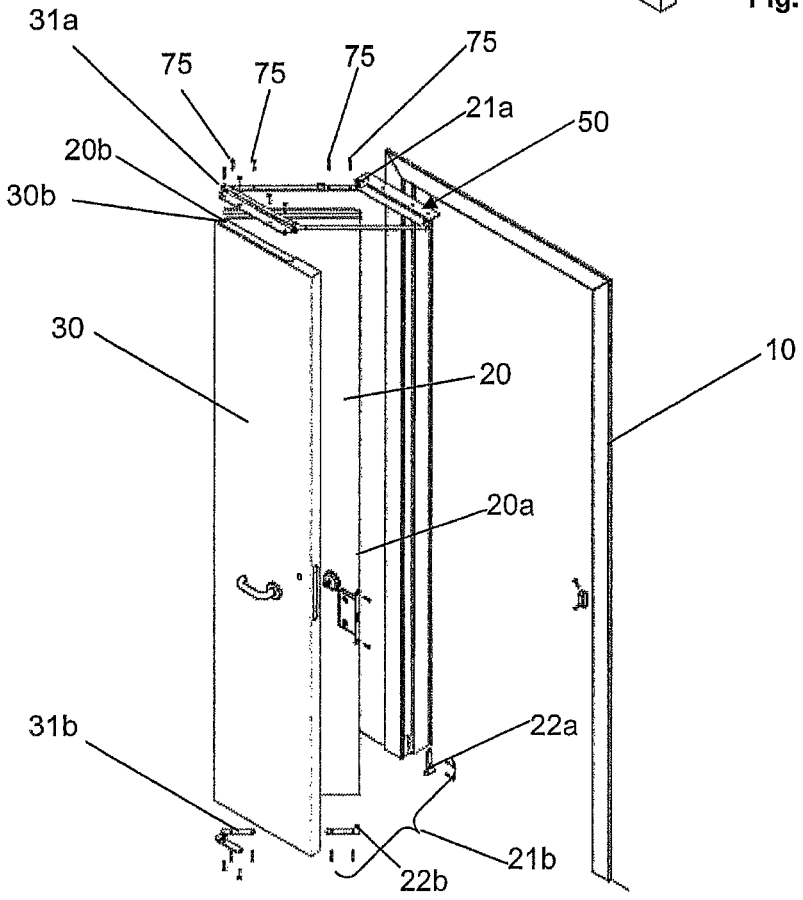
FIGS. 4 and 5 are two respective exploded axonometric views of the closure element of FIGS. 1*a-e* in the two respective assembly configurations.
Figure 5:
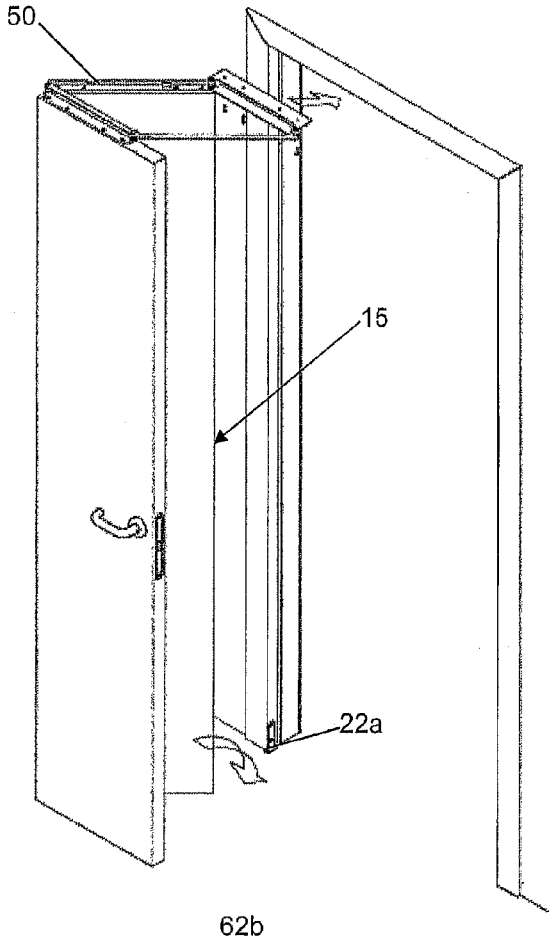
Figure 6:
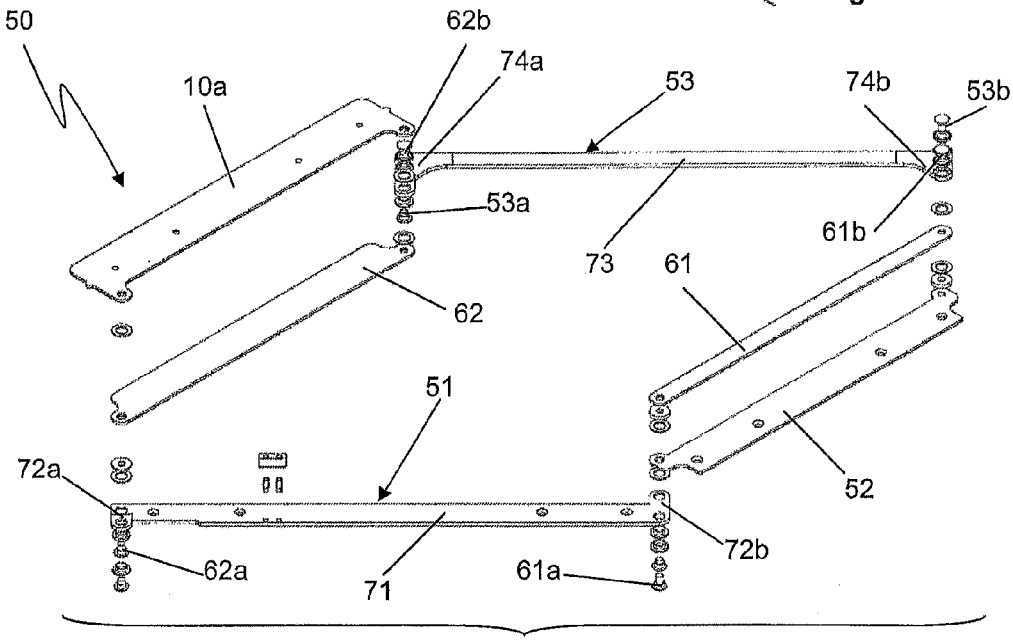
FIG. 6 is an exploded axonometric view of an articulated quadrilateral mechanism according to the present invention, usable for the articulated movement of the closure element of FIGS. 1*a-e* and 3.

With reference to FIG. 4, the mechanism 50 is initially connected to the first and to the second wing 20, 30 respectively by affixing, by means of a plurality of screws 75, the first movable member 51 and the second member 52 in respective recesses 81, 82 obtained on respective top ends of the wings 20, 30. The screws 75 respectively pass through respective holes provided on the first movable member 51 and on the second member 52 and are screwed into respective threaded holes provided on the top end of the wings 20, 30. The first and the second wing 20 and 30 are also connected by the pivot joint 31*b* positioned at the edges 20*b*, 30*b* and at respective bottom ends of the wings 20, 30, opposite the top ends to which the mechanism 50 is affixed. The pivot joint 31*b* consists of a furniture hinge of a type which is per se known and conventional. The mechanism 50 and the pivot joint 31*b* are connected to the wings 20, 30 in such a way that the pivot joint 31*a* between the first movable member 51 and the second member 52 is aligned with pivot joint 31*b* so as to constitute a common rotation axis that coincides with the second rotation axis Z2 of the movable element 1. Again with reference to FIG. 4, a pin 22*a* is connected to the jamb 12*a* at the threshold 11*a*. The pin 22*a* is arranged so as to be aligned or protruding with respect to the second front surface 14*b* of the fixed structure 10. The pin 22*a* is connectible to a corresponding cylindrical cavity 22*b* provided on a metal element screwed to the first wing 20 at the edge 20*a*. With reference to FIG. 5, the assembly formed by the mechanism 50 and the wings 20, 30 and connected to the fixed structure 10 coupling to each other the pin 22*a* and the cavity 22*b* so as to constitute the pivot joint 21*b*, and affixing by means of a pair of screws, the fixed member 10*a* in a respective recess 13*a* obtained on the face of the lintel 13 facing the opening 11. This connection is carried out guaranteeing the alignment between the pivot joints 21*a* and 21*b*, so as to constitute a common rotation axis that coincides with the first rotation axis Z1 of the movable element 1.

The reduced axial dimension of the mechanism 50 allows containment of the dimensions of the recesses 81, 82, 13*a* in the direction parallel to the rotation axes Z1, Z2 and obtainment of a closure element 1, wherein, at least in the closed position, the mechanism 50 is concealed from view from the first space A and from the second space B.

The above-described coupling allows the closure element 1 of the present invention to be moved while maintaining the second wing 30 parallel to itself as shown in the accompanying FIGS. 1*a-e*.

With reference to the accompanying FIGS. 2*a-e* and 13-19, another variant embodiment of a swing closure element is globally indicated by 1'. FIGS. 2*a-e* and 13-19 respectively correspond to FIGS. 1*a-e*, 4-6, 7*c*, 8-9, 11 of the above-described closure element 1. With respect to the latter, in FIGS. 2*a-e* and 13-19 and in the following description, elements identical in form and function are indicated by the same reference numerals used above.

The closure element 1' comprises an articulated quadrilateral mechanism 50' connected to the fixed structure 10 and configured in such a way that, in the second open configuration, the first wing 20 is rotated by 90° with respect to the first closed configuration and the second wing 30 is superimposed and faces the first wing 20. The closure element 1' differs with respect to the closure element 1 in that the mechanism 50' guides the movable, two-wing structure 15 towards an open configuration wherein the first and the second wings 20 and 30 are arranged orthogonally to the opening 11.

With reference to the accompanying FIGS. 15-19, the mechanism 50' comprises a first, plate-shaped fixed member 10*a* rigidly constrained by means of removable threaded coupling to a bottom edge of the lintel 13 facing the opening 11. The mechanism 50' also comprises a first and a second movable member 51, 52' rigidly constrained by respective removable threaded couplings, respectively to the first movable wing 20 and the second movable wing 30. The mechanism 50' further comprises a fourth movable member 53' that is plate-shaped and pivotably connected to the first fixed member 10*a* and to the second movable member 52' respectively by means of a first pin 53*a* and a second pin 53*b*', having respective rotation axes Z3, Z4' parallel to the first and second rotation axis Z1, Z2.

The pins 53*a*, 53*b*' are of a known and conventional type. The distance between the rotation axis Z3 of the first pin 53*a* and the first rotation axis Z1 is greater than the distance between the rotation axis Z4' of the second pin 53*b* and the second axis Z2. The four members 10*a*, 51, 52', 53' of the mechanism 50' are predominantly developed according to respective longitudinal directions and according to respective lengths such as to allow respective 90° rotations of the first wing 20 and the second wing 30 respectively about the first and the second rotation axis Z1, Z2. The dimensions of the members 10*a*, 51, 52', 53' of the mechanism 50' are also selected so that the second movable wing 30 maintains itself almost parallel to the opening 11 in configurations close to the first closed configuration.

The mechanism 50' comprises a first stiffening member 61' and a second stiffening member 62', which are configured and arranged so that in the closed configuration the first stiffening member 61' is parallel to and spaced with respect to the second plane Z2Z4', containing the axes Z2 and Z4', and faces, with respect thereto, the second space B, while the second stiffening member 62 is parallel to and spaced with respect to the first plane Z1Z3 and faces, with respect thereto, the first space A.

The first stiffening member 61' is plate-shaped and extended in a prevalent longitudinal direction and is pivotably constrained at the opposite longitudinal ends, by means of respective pins 61*a,b* coupled to the first movable member 51 and to the third movable member 53', respectively. The pin 61*b* is coupled to a respective sliding guide 91, produced by means of a through slit provided on the third movable member 53', in proximity of the second pin 53*b*'. The slit 91 has a width equal to or slightly greater than the diameter of the pin 61*b* and circular, concentric profile with respect to the rotation axis Z4' of the second pin 53*b*'.

Figure 19:
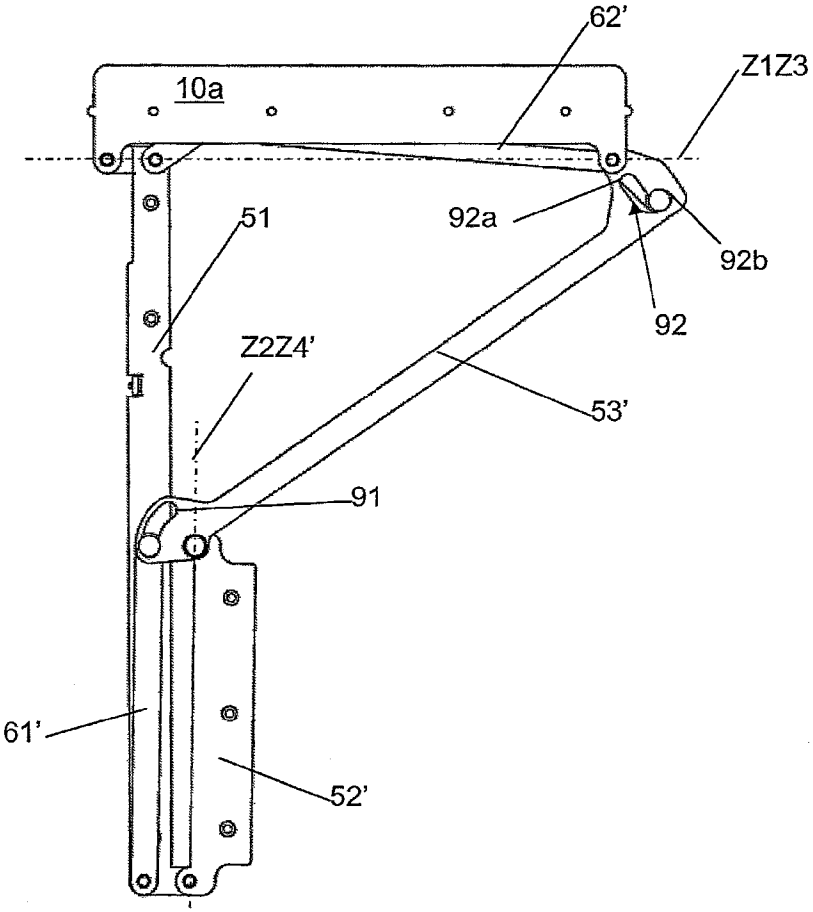
Figure 18:
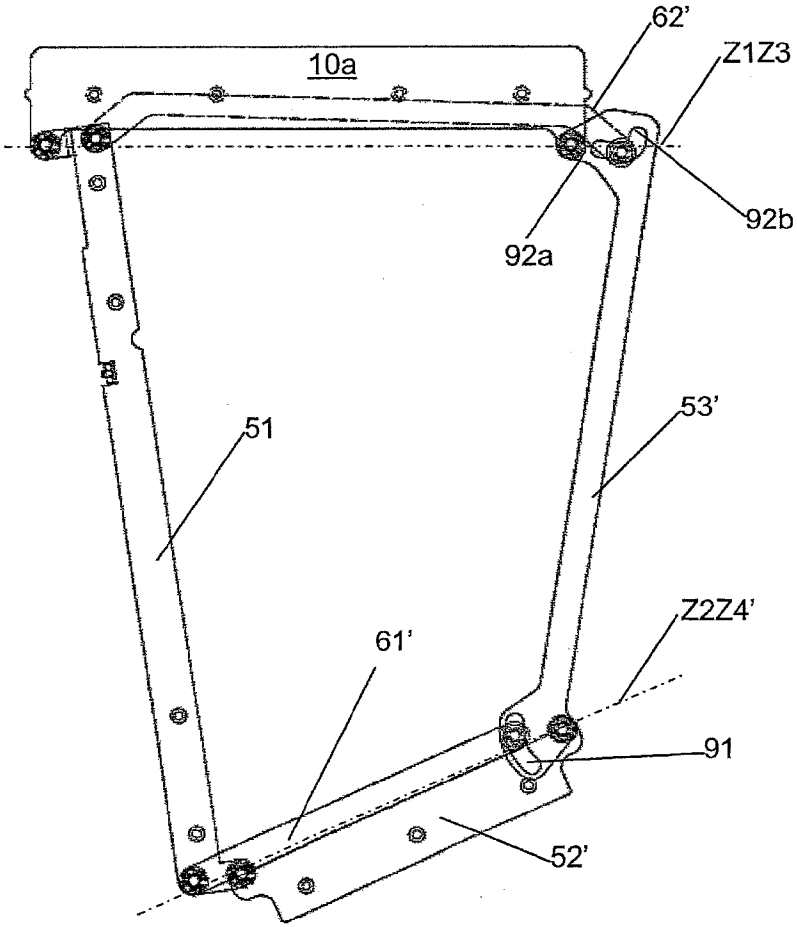

The second stiffening member 62' is also plate-shaped and extended according to a prevalent longitudinal direction. At the opposite longitudinal ends the second stiffening member 62' is pivotably constrained by respective pins 62*a,b* coupled to the first movable member 51 and to the third movable member 53', respectively. The pin 62*b* is coupled to a respective sliding guide 92, produced by means of a second through slit provided on the third movable member 53', in proximity of the first pin 53*a*. The slit 92 has a width equal to or slightly greater than the diameter of the pin 62*b* and comprises a first portion 92*a* and a second section 92*b* that are consecutive and orthogonal to each other. In the first closed configuration the first section 92*a* is orthogonal to the planes Z1Z3 and Z2Z4'. During the movement of the closure element 1' between open and closed configurations, the pin 62*b* moves along the first section 92*a* in the configurations that are closest to the closed configuration (FIGS. 16-18), moving in the second section 92*b* in proximity of the open configuration (FIG. 19).

Figure 20:
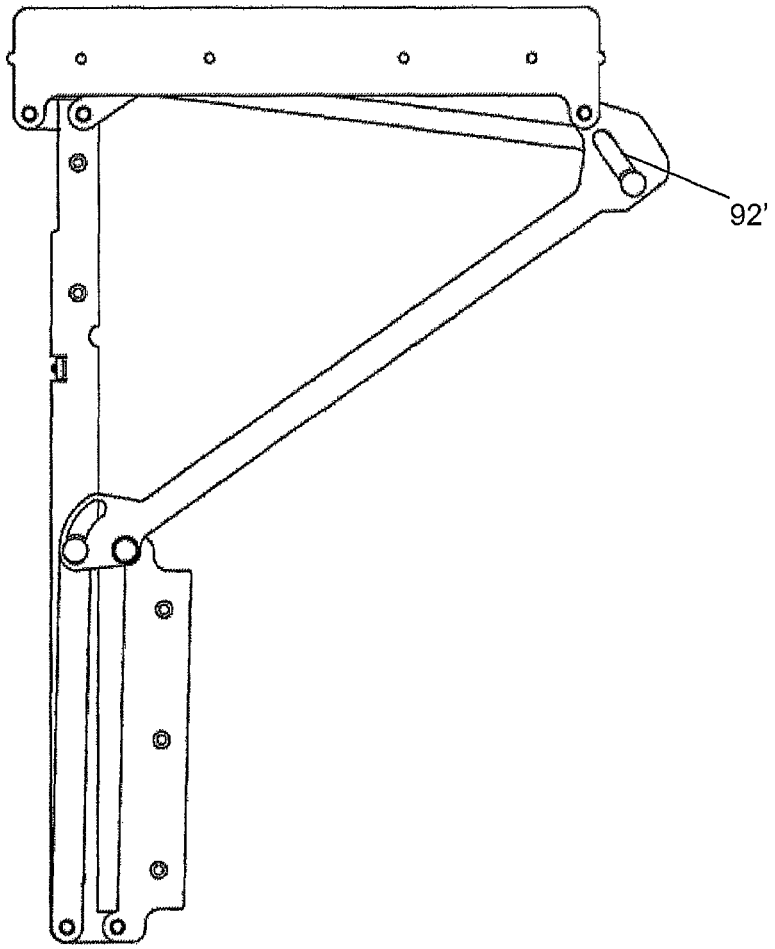
FIG. 20 is a top plan view, corresponding to that of FIG. 19, of one variant embodiment of the articulated quadrilateral mechanism of FIG. 15.

According to a further variant embodiment (FIG. 20), the pin 62*b* is coupled to a respective sliding guide 92' produced by a through slit having a profile consisting of a single straight section oriented so as to be, in the closed configuration, orthogonal to the planes Z1Z3 and Z2Z4'.

In the mechanism 50' the presence of the stiffening members 61', 62' offsets the lack of stall torque in the mechanism 50 in the closed configuration, i.e. in the only configuration close to a theoretical stuck configuration. In this configuration the stiffening members 61', 62' act as tie rods, the sliding of the respective pins 61*b*, 62*b* in the respective guides 91, 92 being inhibited. Indeed, in the closed configuration, respectively, the pin 61*b* of the first stiffening member 61' is located at end stroke within the slit 91 and the second stiffening member 62' is arranged orthogonally to the second slit 92 (or 92' in the case of the variant of FIG. 20).

Starting from the fully closed configuration, the presence of the first stiffening member 61' prevents the second wing 30 from tending to move abruptly rotating about an axis close to the closure 35, as in the traditional folding elements, so as to remain, at least in the first part of the opening movement, almost parallel to the opening 11. The presence of the second stiffening member 62 prevents the first and second wing 20, 30 from tending to move, remaining coplanar, as if the closure element 1' consisted of a traditional swing closure.

The invention thus allows the aims defined with reference to the cited prior art to be achieved, while at the same time allowing a number of further advantages to be achieved. For example, with respect to the traditional folding closure elements, the present solution allows the use of a closure 35 such as those normally used for traditional swing closure elements. This allows, together with the fact that the second wing 30 in proximity of the closed configuration is maintained parallel or almost parallel to itself, a stable and safe closure to be obtained, wherein any undesired opening, by effect of impacts in proximity of the second rotation axis Z2 for example, is prevented. Furthermore, the present invention provides a particularly ergonomic closure element that requires reduced and more easily controllable movements with respect to the traditional swing, folding and sliding solutions, so as to facilitate the use thereof for all of the users and in particular for those with reduced mobility.

The invention claimed is:

1. Swing closure element (1, 1') for doors, windows or the like, comprising:

a fixed structure (10), rigidly constrainable to an opening (11) of a door or window or the like, to separate a first space (A) from a second space (B), a first movable wing (20) constrained to said fixed structure (10) by a first hinge constraint (21) so as to be pivotable with respect to said fixed structure (10) about a first rotation axis (Z1) of said first constraint (21) according to a predetermined opening rotation direction (W1) oriented from said first space (A) to said second space (B) and an opposite closing rotation direction (W2) oriented from said second space (B) to said first space (A), a second movable wing (30) constrained to said first wing by a second hinge constraint (31) so as to be pivotable with respect to said first wing (20) about a second rotation axis (Z2) of said second constraint (31), said first and second wings (20, 30) being movable between a first closed configuration wherein said first and second wings (20, 30) are coplanarly arranged to close said opening (11) and at least a second open configuration wherein the passing between said spaces (A, B) through said opening (11) is allowed, an articulated quadrilateral mechanism (50) comprising:

a fixed member (10*a*) rigidly constrained to said fixed structure (10);

a first movable member (51) rigidly constrained to said movable wing (20) and pivotably constrained to said fixed member (10*a*) by said first hinge constrained (21), a second movable member (52, 52') rigidly constrained to a second movable wing (30) and pivotably constrained to said first movable member (51) by said second hinge constraint (31) and a third movable member (53, 53') connected to said fixed member (10*a*) and to said second movable member (52, 52') by a first pin (53*a*) and a second pin (53*b*, 53*b*'), respectively, said mechanism (50, 50') being pivotable according to said predetermined opening rotation direction (W1) starting from a first closed configuration wherein said four members (10*a*, 51; 52, 52'; 53, 53') are parallel to each other, said first and second hinge constraints (21, 31) being arranged in said closed configuration so that a first plane (Z1Z3) containing the axis (Z1) of said first constraint (21) and the axis of said first pin (53*a*) is spaced from a second plane (Z2Z4, Z2Z4') containing the axis (Z2) of said second constraint (31) and the axis of said second pin (53*b*, 53*b*'), said rotation direction (W1) being oriented from said second plane (Z2Z4, Z2Z4') to said first plane (Z1Z3), said closure element being characterized in that said mechanism (50, 50') comprises at least one first stiffening member (61, 61') pivotably constrained to a said first movable member (51) and to a said third movable member (53, 53') so that in said closed configuration:

said first stiffening member (61, 61') is parallel to and spaced with respect to a plane containing said second axis (Z2) and the axis of said second pin (53*b*, 53*b*') and said rotation direction (W1) is oriented from said second plane (Z2Z4, Z2Z4') to said first stiffening member (61, 61').

2. Closure element (1, 1') according to claim 1, wherein said one mechanism (50, 50') is configured so that in said closed configuration said stiffening member (61, 61') is parallel and spaced with respect to a plane (Z2Z4, Z2Z4') containing said second axis (Z2) and the axis (Z4, Z4') of said second pin (53*b*, 53*b*').

3. Closure element (1, 1') according to claim 2, wherein said second hinge constraints (31), said second pin (53*b*, 53*b*') and said first stiffening member (61, 61') are mutually arranged so that in said closed configuration said first stiffening member (61, 61') faces said second space (B) with respect to said plane (Z2Z4, Z2Z4') containing said second axis (Z2) and said axis (Z4) of said second pin (53*b*, 53*b*').

4. Closure element (1, 1') according to claim 3, wherein said mechanism (50, 50') comprises at least a second stiffening member (62, 62'), said first and second stiffening members (61, 61'; 62, 62'), being respectively arranged in proximity of said second wing (30) and to said fixed structure (10), said first hinge constraint (21), said first pin (53*a*) and said second stiffening member (62, 62') being mutually arranged so that in said closed configuration said second stiffening member (62, 62') faces said first space (A) with respect to a plane (Z1Z3) containing said first axis (Z1) and the axis (Z3) of said first pin (53*a*).

5. Closure element (1) according to claim 1, wherein said mechanism (50) is a mechanism of the parallelogram type, the distance between said first pin (53*a*) and said first axis (Z1) being equal to the distance between said second pin (53*b*) and the second axis (Z2), so that said second wing (30) is moveable with respect to said fixed structure (10) remaining parallel with respect to said opening (11).

6. Closure element (1) according to claim 5, wherein said first hinge constraint (21) allows a 180° rotation of said first movable wing (20) so that in said second open configuration said first wing (20) is rotated by 180° with respect to said first closed configuration and said second wing (30) is superimposed to said first wing (20).

7. Closure element (1') according to claim 1, wherein the distance between the first pin (53*a*) and said first axis (Z1) is greater than the distance between said second pin (53*b*') and said second axis (Z2), said mechanism (50') being dimensioned so that in said second open configuration of said first wing (20) it is rotated by 90° with respect to said first closed configuration and said second wing (30) is superimposed to said first wing (20).

8. Articulated quadrilateral mechanism (50, 50') for moving a swing closure element (1) for doors, windows or the like, said mechanism (50, 50') comprising:

a fixed member (10*a*) rigidly constrainable to a fixed structure (10), a first movable member (51) rigidly constrainable to a first movable wing (20) and pivotably constrained to said fixed member (10*a*) by a first hinge constraint (21), a second movable member (52, 52') rigidly constrainable to a second movable wing (30) and pivotably constrained to said first movable member (51) by a second hinge constraint (31) and a third movable member (53, 53') connected to said fixed member (10*a*) and to said second movable member (52, 52') by a first pin (53*a*) and a second pin (53*b*, 53*b*'), respectively said mechanism (50, 50') being pivotable according to a predetermined opening rotation direction (W1) starting from a first closed configuration wherein said four members (10*a*, 51; 52, 52'; 53, 53') are parallel to each other, said first and second hinge constraints (21, 31) being arranged in said closed configuration so that a first plane (Z1Z3) containing the axis (Z1) of said first constraint (21) and the axis of said first pin (53*a*) is spaced from a second plane (Z2Z4, Z2Z4') containing the axis (Z2) of said second constraint (31) and the axis of said second pin (53*b*, 53*b*'), said rotation direction (W1) being oriented from said second plane (Z2Z4, Z2Z4') to said first plane (Z1Z3), said mechanism (50, 50') being characterized in that it comprises at least one first stiffening member (61, 61') pivotably constrained to a said first movable member (51) and to a said third movable member (53, 53') so that in said closed configuration:

said first stiffening member (61, 61') is parallel to and spaced with respect to a plane containing said second axis (Z2) and the axis of said second pin (53*b*, 53*b*') and said rotation direction (W1) is oriented from said second plane (Z2Z4, Z2Z4') to said first stiffening member (61, 61').

9. Mechanism (50, 50') according to claim 8, wherein said mechanism (50, 50') comprises at least a second stiffening member (62, 62'), said first and second stiffening members (61, 61'; 62, 62'), being respectively arranged in proximity of said second movable member (52, 52') and to said fixed member (0*a*), said first hinge constraint (21), said first pin (53*a*) and said second stiffening member (62, 62') being mutually arranged so that in said closed configuration said rotation direction (W1) is oriented from said second stiffening member (62, 62') towards said first plane (Z1Z3).

10. Articulated quadrilateral mechanism (50) according to claim 8, wherein said mechanism (50) is a mechanism of the parallelogram type, the distance between said first pin (53*a*) and said first axis (Z1) being equal to the distance between said second pin (53*b*) and said second axis (Z2), so that said second wing (30) is movable with respect to said fixed structure (10) while remaining parallel with respect to said opening (11), each of said first and second stiffening means (61, 62) being pivotably constrained to said movable third member (53) by a respective pin (61*b*, 62*b*) coupled to a respective hole provided on said third movable member (53).

11. Articulated quadrilateral mechanism (50') quadrilateral according to claim 8, wherein the distance between said first pin (53*a*) and said first axis (Z1) is greater than the distance between said second pin (53*b'*) and said second axis (Z2), so as to move said second wing (30) up to a second open configuration wherein said first wing (20) is rotated 90° with respect to said first closed configuration and said second wing (30) is superimposed to said first wing (20), each of said first and second stiffening means (61', 62') being pivotably constrained to said third movable member (53') by a respective pin (61*b*, 62*b*) coupled to a respective sliding guide (91, 92) provided on said third movable member (53').

* * * * *